US007748704B2

(12) United States Patent
Terao et al.

(10) Patent No.: US 7,748,704 B2
(45) Date of Patent: Jul. 6, 2010

(54) PAPER SHEET PROCESSING APPARATUS, AND PAPER SHEET PROCESSING METHOD

(75) Inventors: Yasunobu Terao, Izunokuni (JP); Mikio Yamamoto, Izunokuni (JP); Yoshiaki Sugizaki, Sunto-gun (JP); Hajime Yamamoto, Mishima (JP); Hiroyuki Taki, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 462 days.

(21) Appl. No.: 11/531,822

(22) Filed: Sep. 14, 2006

(65) Prior Publication Data

US 2007/0057443 A1 Mar. 15, 2007

(30) Foreign Application Priority Data

Sep. 15, 2005 (JP) ..... 2005-268877

(51) Int. Cl.
*B65H 31/00* (2006.01)

(52) U.S. Cl. ..... 271/207; 271/221; 271/218; 271/220; 270/58.11; 270/58.12; 270/58.17; 270/58.27

(58) Field of Classification Search ..... 271/221, 271/207, 218, 220; 270/58.11, 58.12, 58.17, 270/58.27

See application file for complete search history.

(56) References Cited

U.S. PATENT DOCUMENTS 5,478,062 A * 12/1995 Horiuchi et al. ..... 270/58.08
5,931,460 A * 8/1999 Kadowaki et al. ..... 271/220
6,220,592 B1 * 4/2001 Watanabe et al. ..... 271/241
7,392,983 B2 * 7/2008 Kodama et al. ..... 271/249
7,419,150 B2 * 9/2008 Kushida et al. ..... 270/58.07
7,461,837 B2 * 12/2008 Saito et al. ..... 270/58.07
2003/0062669 A1 * 4/2003 Yamakawa et al. ..... 271/176

(Continued)

FOREIGN PATENT DOCUMENTS

| | | |
|---|---|---|
| JP | 10226458 | 8/1998 |
| JP | 2001-302081 | 10/2001 |
| JP | 2002-362825 | 12/2002 |
| JP | 2004-269249 | 9/2004 |

OTHER PUBLICATIONS

Japanese Office Action for 2005-268877 mailed on Jan. 19, 2010.

*Primary Examiner*—Patrick Mackey
*Assistant Examiner*—Prasad V Gokhale
(74) *Attorney, Agent, or Firm*—Turocy & Watson, LLP

(57) ABSTRACT

A post-processing apparatus has a standby tray to receive a paper sheet to be supplied from a digital copier, a processing tray to receive a paper sheet dropped from a standby tray, a feed member which guides the rear end of a paper sheet received in a standby tray in the feeding direction to a processing tray, and scrapes and sends the rear end of a paper sheet dropped onto a processing tray to a stopper, a press member which clamps the rear end of a paper sheet received in a standby tray by cooperating with two feed members, and a stapler to staple the aligned rear ends of paper sheets. When a first paper sheet is supplied to the standby tray, the press member presses the rear end of the first paper sheet, to receive a second paper.

14 Claims, 7 Drawing Sheets

U.S. PATENT DOCUMENTS

2004/0070141 A1* 4/2004 Michels et al. ..... 271/220
2006/0067766 A1* 3/2006 Terao et al. ..... 399/405
2006/0071410 A1* 4/2006 Koie ..... 271/207
2006/0071411 A1* 4/2006 Obuchi et al. ..... 271/207
2006/0078363 A1* 4/2006 Terao et al. ..... 399/407
2006/0097445 A1* 5/2006 Fukatsu et al. ..... 271/220
2006/0208411 A1* 9/2006 Saito et al. ..... 270/58.07
2006/0214346 A1* 9/2006 Terao et al. ..... 270/58.08
2007/0029724 A1* 2/2007 Sato ..... 271/220
2007/0145674 A1* 6/2007 Saito ..... 271/207

* cited by examiner

PAPER SHEET PROCESSING APPARATUS, AND PAPER SHEET PROCESSING METHOD

CROSS-REFERENCE TO RELATED APPLICATIONS

This application is based upon and claims the benefit of priority from prior Japanese Patent Application No. 2005-268877, filed Sep. 15, 2005, the entire contents of which are incorporated herein by reference.

BACKGROUND OF THE INVENTION

1. Field of the Invention

The present invention relates to a paper sheet processing apparatus having a standby tray to stack and hold a paper sheet to be supplied to a processing tray, and a paper sheet processing method.

2. Description of the Related Art

There is a conventional paper sheet post-processing apparatus having a sheet stock unit provided with a paddle in a conveying path to lead a paper sheet to a processing tray to stack a plurality of paper sheet and to staple the stacked paper sheets (e.g., Jpn. Pat. Appln. KOKAI Publication No. 2001-171889, Summary, FIG. 7-FIG. 15). This sheet stock unit functions to hold a plurality of paper sheet until the stapling in the processing tray is finished.

In the above apparatus, whenever a paper sheet is stocked in the sheet stock unit, the paddle is rotated to press down the rear end of the paper sheet in the conveying direction to prevent interference with a next paper sheet supplied to the sheet stock unit. Therefore, when stocking two or more paper sheets, a previously stacked sheet is prevented from being collided with a next supplied paper, and two or more paper sheets can be stocked in an orderly stacked state.

However, in the above conventional paper sheet post-processing apparatus, since the paddle is rotated by 180° and the rear end of the paper sheet is bent down just like being tapped by the paddle each time a paper sheet is supplied to the sheet stock unit, a relative large noise is generated. Further, since the sheet rear end is forcibly bent downward from the conveying path each time a paper sheet is stacked, the rear end of the paper sheet is curled when a stocked paper sheets are supplied to the processing tray, causing a problem of disturbing the stacked state.

BRIEF SUMMARY OF THE INVENTION

It is an object of the invention to provide a paper sheet processing apparatus capable of stably stacking a paper sheet on a standby tray, and a paper sheet processing method.

In order to achieve the above object, a paper sheet processing apparatus according to an embodiment of the invention has a standby tray to receive a paper sheet to be fed in a first direction, and a press member to press down the rear end of a paper sheet received in the standby tray along the first direction, when receiving another paper sheet in the standby tray.

According to the invention, when receiving a paper sheet in the standby tray, the rear end of a paper sheet already received in the standby tray is pressed by a press member, and the position of the already stacked paper sheet is not disturbed by colliding with another paper sheet supplied next, and paper sheets are stably stacked.

According to an embodiment of the invention, there is provided a paper sheet processing apparatus comprising a standby tray which receives an object paper sheet in a first substantially horizontal direction; a processing tray which is provided under the standby tray, and receives a paper sheet dropped from the standby tray; a stopper which comes in contact with the rear end of a paper sheet received in the processing tray along the first direction; a feed member which is provided between the standby tray and processing tray, and has a tab to support the rear end of a paper sheet received in the standby tray, a stick to tap the rear end of the paper sheet downward, an elastic paddle to scrape and send the paper sheet dropped onto the processing tray to the stopper, and a rotary unit connected to the rear ends of the tab, stick and paddle, guides the rear end of a paper sheet received in the standby tray to the processing tray, scrapes and sends the paper sheet dropped onto the processing tray to the stopper, and collides the rear end of the paper sheet with the stopper, by rotating the rotary unit; and a press member which presses down the rear end of a paper sheet received in the standby tray and supported by the tab, and clamps the rear end of the paper sheet by cooperating with the tab.

According to the invention, when the rear end of a paper received in the standby tray is pressed by the press member, the rear end is clamped by cooperating with the tab supporting the rear end of the paper, and the already stacked paper sheet is not displaced by a next paper sheet supplied to the standby tray. When dropping the paper sheet stacked on the standby tray onto the processing tray, the rear end of the paper sheet is guided to the processing tray by releasing the support of the rear end by the tab, and the press member does not obstruct the operation.

According to another embodiment, there is provided a paper sheet processing method comprising a first receiving step of receiving a first paper sheet to be fed in a first direction by a standby tray; a step of pressing the rear end of the received first paper sheet along the first direction by a press member; and a second receiving step of receiving a second paper sheet to be fed in a second direction in the standby tray by passing over the press member and stacking on the first paper sheet.

According to the invention, the rear end of the first paper sheet received in the standby tray is pressed by the press member, and the second paper sheet is passed over the press member and stacked on the first paper sheet. Therefore, the position of the already stacked first paper sheet is not disturbed by colliding with the second paper sheet supplied next, and all paper sheets are stably stacked.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter preferred embodiments of the invention will be explained in detail with reference to the accompanying drawings.

Figure 1:
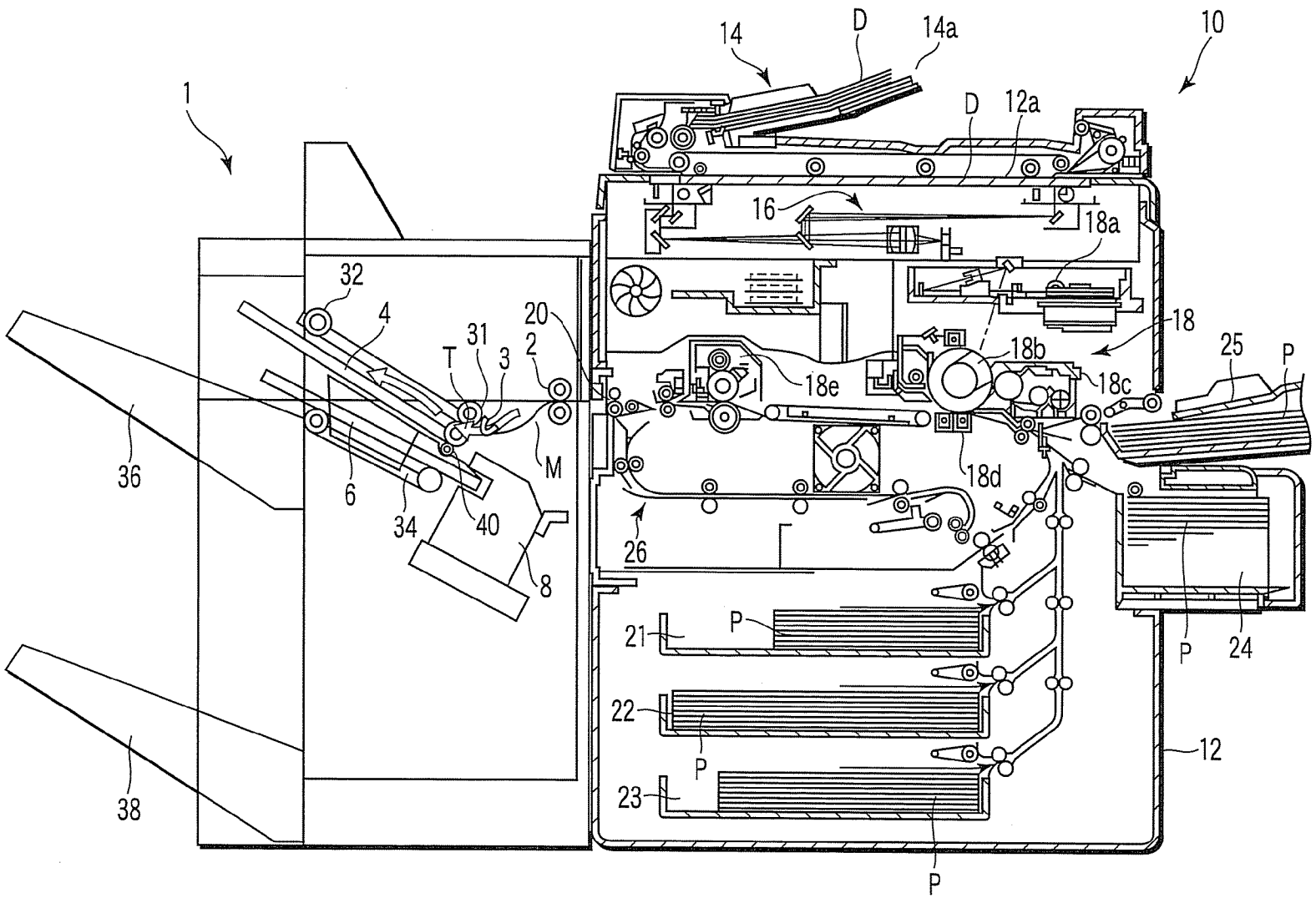
FIG. 1 is a schematic diagram showing a digital copier having a post-processing apparatus according to an embodiment of the invention.

FIG. 1 is a schematic diagram of a digital copier 10 connected with a post-processing apparatus 1 which functions as a paper sheet processing apparatus according to an embodiment of the invention.

The digital copier 10 has a housing 12 constructed as an outer case of the apparatus, and a document table 12*a* made of a transparent glass plate on the top of the housing 12. On the document table 12*a*, a retractable automatic document feeder 14 (hereinafter called simply an ADF 14) is provided. The ADF 14 automatically feeds a document D to a predetermined position on the document table 12*a*.

For example, place the document D on a paper supply tray 14*a* of the ADF 14, set the number of copies and the size of paper, specify whether to staple or not, and select the method of stapling, and press the copy start switch. Then, the document D on the paper supply tray 14*a* is automatically fed one by one to the document reading position on the document table 12*a*, and automatically ejected at an appropriate timing after being read.

Within the housing 12, a scanner 16, a printer 18, and copy paper P cassettes 21, 22 and 23 are provided. A large-capacity feeder 24 containing a large number of the same-size paper, and a manual-feed tray 25 are provided on the right-side wall of the housing in the drawing. A post-processing apparatus 1 described later is connected to the left-side wall of the housing 12 in the drawing.

The scanner 16 scans by illuminating the document D supplied to the document reading position on the document table 12*a* by the ADF 14, and reads and photoelectrically converts the reflected light, thereby obtaining the image information about the document D.

The printer 18 energizes a laser unit 18*a* based on the image information read by the scanner 16, and forms an electrostatic latent image on the outer surface of a photoconductive drum 18*b* based on the image information. The printer 18 visualizes the electrostatic latent image formed on the photoconductive drum 18*b* by supplying toner through a developing unit 18*c*, and transfers this toner image to a copy paper P through a transfer charger 18*d*. In this time, the copy paper P is supplied from the cassette 21/22/23, the large-capacity feeder 24, or the manual-feed tray 25. Further, the printer 18 supplies the copy paper P holding the transferred toner image to a fixing unit 18*e*, fixes the toner image to the copy paper P by heating and fusing the toner, and ejects the copy paper P to the post-processing apparatus 1 through an ejection slit 20. The copy paper P ejected through the ejection slit 20 corresponds to a paper sheet M in the present invention.

After passing through the fixing unit 18*e*, if a two-sided copy is necessary, the copy paper P is sent to a reverse conveying path 26, where the side of the copy paper P is reversed, and the copy paper P is supplied again to a fixing area between the photoconductive drum 18*b* and the fixing unit 18*e*.

The post-processing apparatus 1 stacks and aligns the copy paper holding the formed image, that is, the paper sheet M ejected through the ejection slit 20 of the digital copier 10, by a predetermined number of copies (a unit of binding as a bundle), and staples the stacked copy paper. The stapling mentioned here means binding the stacked paper sheets M by aligning one end of them. The post-processing apparatus 1 is also operated in a sort mode to simply sort and eject the paper sheet M holding the formed image in a predetermined number of copies.

The post-processing apparatus 1 has an inlet roller 2 and an inlet sensor 3 at the positions opposite to the eject slit 20 of the digital copier 10. The inlet sensor 3 detects passage of the front and rear ends of the paper sheet M supplied to the post-processing apparatus 1 through the inlet roller 2, in the feeding direction (a first direction) (in the direction of the arrow T in the drawing).

The post-processing apparatus 1 has a standby tray 4 to stack and hold a plurality of paper sheet M fed in the direction of the arrow T through the inlet roller 2, a processing tray 6 to receive the paper sheet M dropped from the standby tray 4 and to align the rear end of the paper sheet for stapling, and a stapler 8 to staple the rear end of the paper sheet M stacked and aligned on the processing tray 6. The standby tray 4 and processing tray 6 are provided inclined downward toward the rear end of the direction of feeding the paper sheet M.

Stapling by the stapler 8 takes a certain processing time. Thus, while the paper sheet M of the processing tray 6 is being stapled, it is necessary to hold the next predetermined number of paper sheet M in another place. In this embodiment, while a previous unit of paper sheet M is being stapled, the first two sheets of the next unit of paper sheet M is held on the standby tray 4, ensuring the time for stapling the previous unit of paper sheet M.

Namely, the first and second paper sheets M fed in the direction of the arrow T are stacked on the standby tray 4, and dropped onto the processing tray 6, after the previous unit of paper is stapled, and then the third and following paper sheets M are stacked one by one on the processing tray 6 through the standby tray 4.

Figure 2:
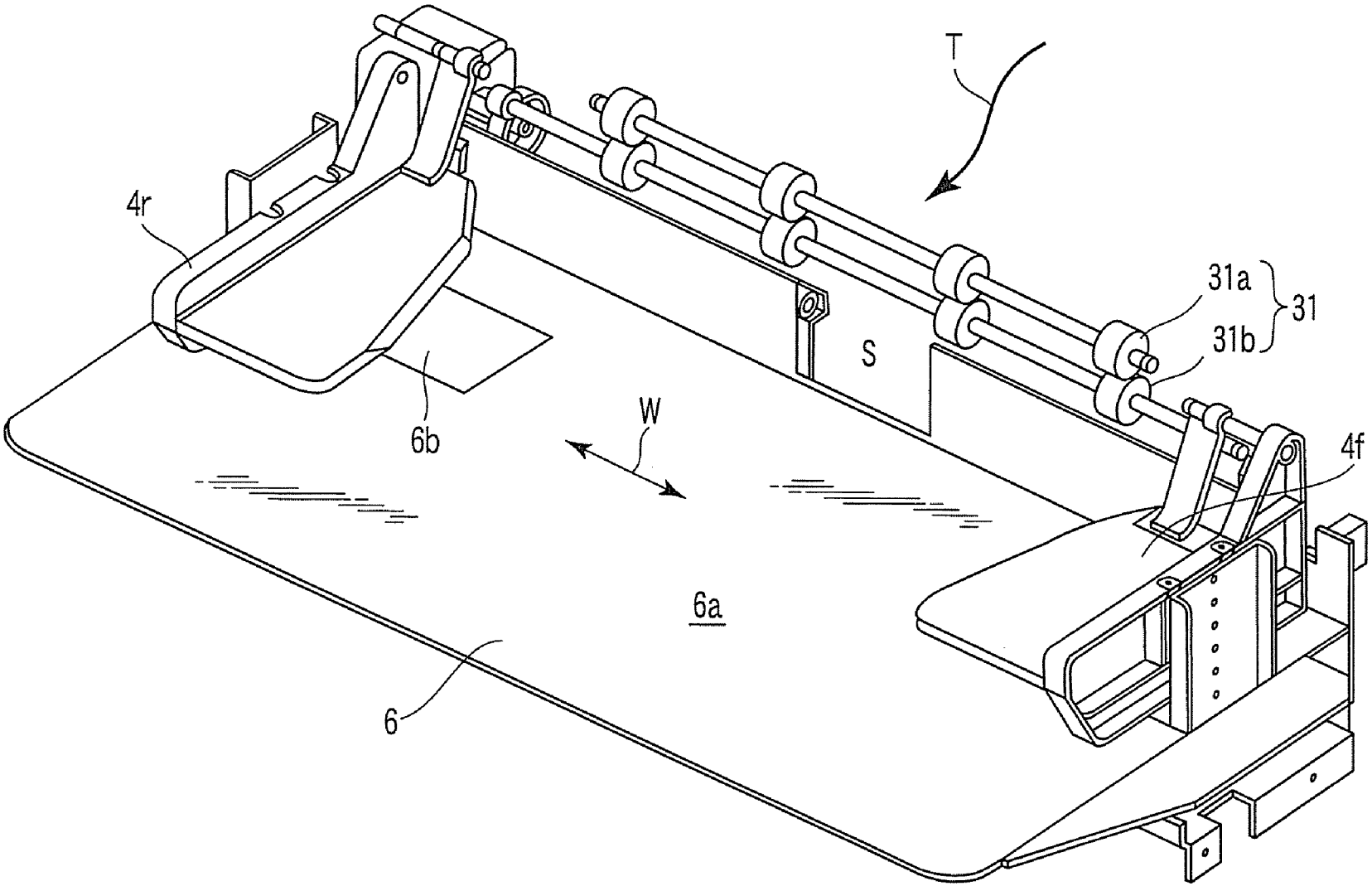
FIG. 2 is a perspective view showing a standby tray of the post-processing apparatus of FIG. 1.

As shown in FIG. 2, the standby tray 4 has two open/close trays 4*r* and 4*f* to open/close in the direction crossing the paper sheet M feeding direction T (the direction of the arrow W in the drawing) (hereinafter called a width direction W). The open/close trays 4*r* and 4*f* are connected to a motor through a not-shown rack-pinion mechanism, and are synchronously opened/closed between a support position to support the area close to the corners of the rear end of the paper sheet M fed in the direction of the arrow T, and a release position to release the supporting.

When the open/close trays 4*r* and 4*f* open to the release position, the sheets M fall from the standby tray 4. More precisely, each sheet M falls, first at the part that is rear with respect to the feeding direction. This is because the opening made between the open/close trays 4*r* and 4*f* gradually broadens in the direction opposite to the feeding direction. Since both the standby tray 4 and processing tray 6 are inclined downward toward the rear end side, the stacked paper sheets M are slightly energized toward the rear end side by the own weight, when the paper sheets M drops from the standby tray 4 onto the processing tray 6.

In the upstream side of the feeding direction of the standby tray 4, or at the rear end side of the paper sheet M, a paper supply roller 31 is provided to clamp the paper sheet M fed in the direction of the arrow T and to supply it to the standby tray 4. The paper supply roller 31 has a plurality of upper roller 31*a* and lower roller 31*b* opposite to one another. The paper supply roller 31 is controlled to start rotation when the inlet sensor 3 detects the passage of the front end of the paper sheet M in the feeding direction, and to stop rotation when the inlet sensor 3 detects the passage of the rear end of the paper sheet M in the feeding direction.

A standby tray roller 32 is provided (omitted in FIG. 2) in the downstream side of the feeding direction of the standby tray 4, or in the front end side of the paper sheet M, as shown in FIG. 1. The standby tray roller 32 is provided opposite to and detachably from the paper sheet mounting surface of the standby tray 4, and is rotatable in both forward and rearward directions. Namely, the roller 32 rotates rearward to adjust the position of the paper sheet M supplied to the standby tray 4 by slightly moving it reversely to the feeding direction T, and rotates forward to eject the paper sheet M directly toward paper eject trays 36 and 38, after the paper sheet M unnecessary to be stapled is stacked on the standby tray 4. The paper eject trays 36 and 38 are movable up and down to meet a processing object.

In particular, the standby tray roller 32 retracts upward when stacking the paper sheet M in the standby tray 4, and descends toward the standby tray 4 after stacking the paper sheet M. In the state that the standby tray roller 32 contacts the stacked paper sheets M, rotate the standby tray roller 32 reversely, and align the rear end of the paper sheet M in the feeding direction by colliding the rear end with a not-shown stopper. Then, the standby tray roller 32 retracts again upward to send a next paper sheet M to the standby tray 4.

The processing tray 6 has a flat paper sheet mounting surface 6*a* to receive and stack the paper sheet M dropped from the standby tray 4. The processing tray 6 has an opening 6*b* to expose a part of a conveying mechanism 34 (refer to FIG. 1) for feeding the paper sheets M stacked on the processing tray 6 to the eject trays 36 and 38 described later. The conveying mechanism 34 can be moved in the reverse direction to send the paper sheets M stacked on the processing tray 6 to a stopper 50 described later.

Figure 3:
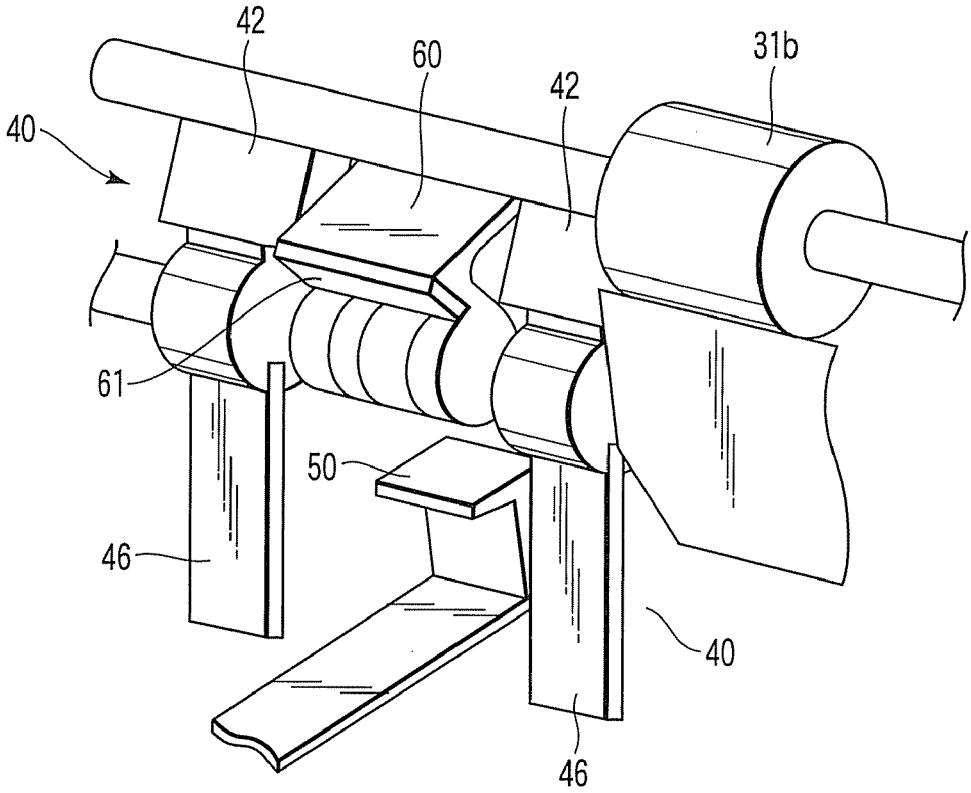
FIG. 3 is a partially enlarged perspective view showing a feed member and a press member provided between a standby tray and a processing tray.

A feed member 40 shown enlarged in FIG. 3 is provided between the standby tray 4 and the processing tray 6. In this embodiment, two feed members 40 are provided separately in the direction of the rotation axis, but three or more feed members 40 may be provided. The structure shown in FIG. 3 is incorporated in the space shown by S in FIG. 2.

Namely, these feed members 40 are provided at the positions to act on the rear end of the feeding direction of the paper sheet M received in the standby tray 4, and guides the rear end of the paper sheet M to the processing tray 6, and sends the area close to the rear end of the paper sheet M dropped onto the processing tray 6, in the direction reverse to the feeding direction, just like by scraping that area.

Figure 4:
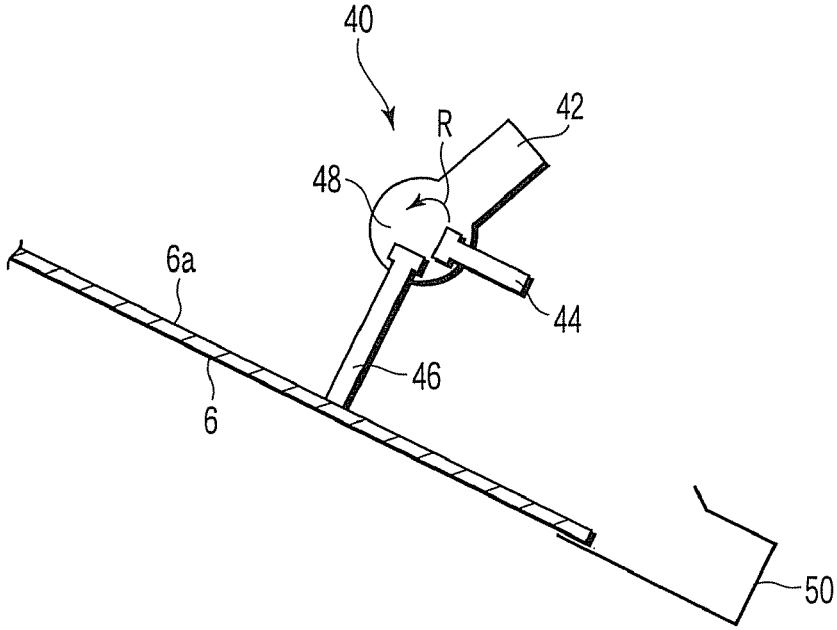
FIG. 4 is a front view of the feed member of FIG. 3.

In particular, as shown in FIG. 4, each feed member 40 has a tab 42 to support thereon the rear end of the paper sheet M supplied to the standby tray 4, a stick 44 to tap down the rear end of the paper sheet M received by the tab 42, a paddle 46 to send the area close to the rear end of the paper sheet M dropped onto the processing tray 6 to the stopper 50 by scraping that area, a rotary body 48 connected to the proximal ends of the tab 42, stick 44 and paddle 46. Namely, the feed member 40 operates by rotating the rotary body 48 in the direction of the arrow R (counter-clockwise) in the drawing.

Figure 10:
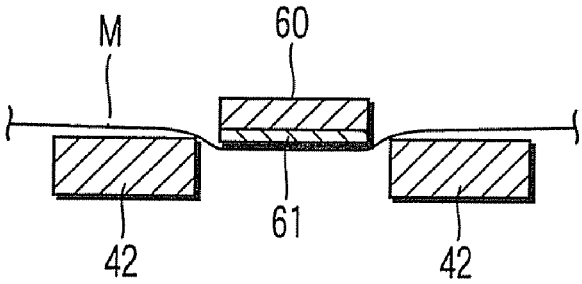
FIG. 10 is a view showing a clamped state of paper sheets, when the press member of FIG. 3 is operated.

Between two feed members 40, a press member 60 (FIG. 3) is provided to press down the rear end of the paper sheet M received in the standby tray 4. As shown in FIG. 10, the press member 60 is provided like a nest between two tabs 42 of two feed members 40, and operates just like pressing down the rear end of the paper sheet M supported by the tab 42, and clamps the rear end of the paper sheet M by cooperating with two tabs 42. A rubber material 61 to prevent slipping is stuck to the surface of the press member 60 to contact the paper sheet M.

Figure 11A:
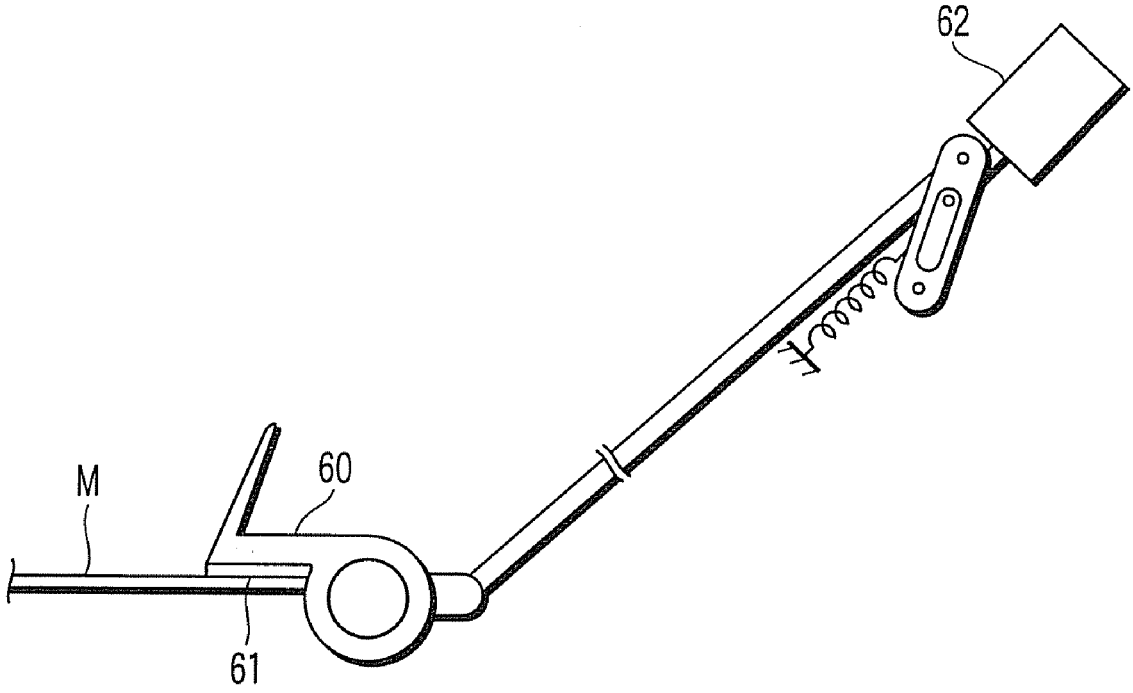
FIG. 11A is a view showing the state that the press member of FIG. 3 is pivotally moved to an operating position.
Figure 11B:
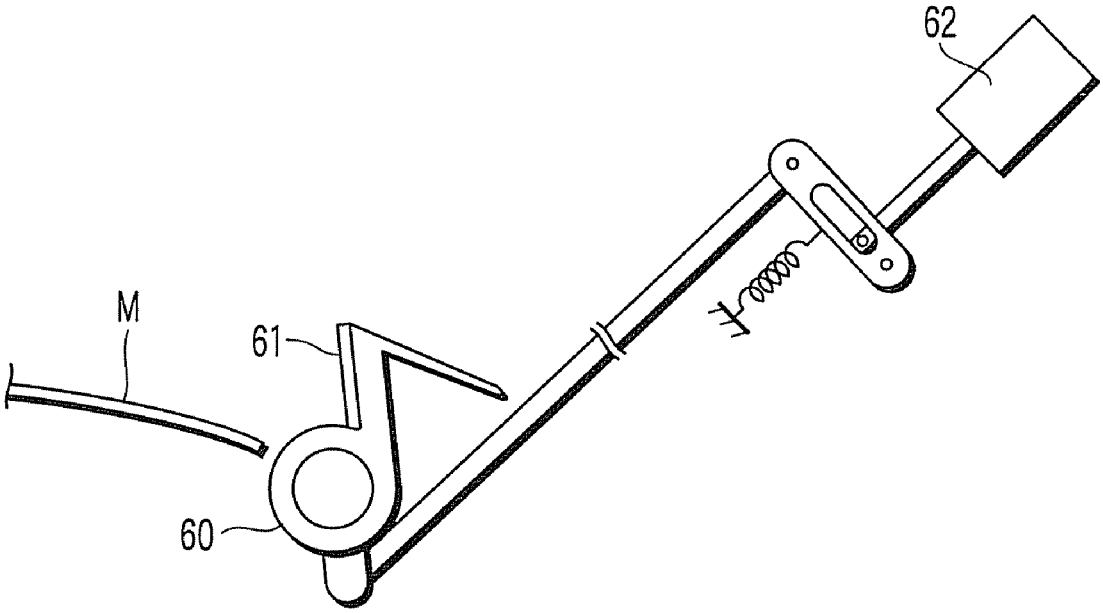
FIG. 11B is a view showing the state that the press member of FIG. 3 is pivotally moved to a retracted position.

The press member 60 is operated by a solenoid 62 as shown in FIG. 11. Namely, the press member is placed at the operating position to press the rear end of the paper sheet M as shown in FIG. 11A, when the solenoid 62 is turned on, and is placed at the retracted position above the paper sheet M as shown in FIG. 11B, when the solenoid 62 is turned off. The pressing force of the press member 60 to act on the paper sheet M is given by a not-shown α-spring, in the state that the press member 60 is placed at the operating position. A driving mechanism to operate the press member 60 between two positions is not limited to a solenoid.

Hereinafter, the operation of the post-processing apparatus 1 will be explained with reference to FIG. 5-FIG. 9. In the description given here, it is assumed that a mode of stapling a predetermined number of paper sheet M is selected in the digital copier 10. In FIG. 5 to FIG. 9, the press member 60 is not shown.

Figure 5:
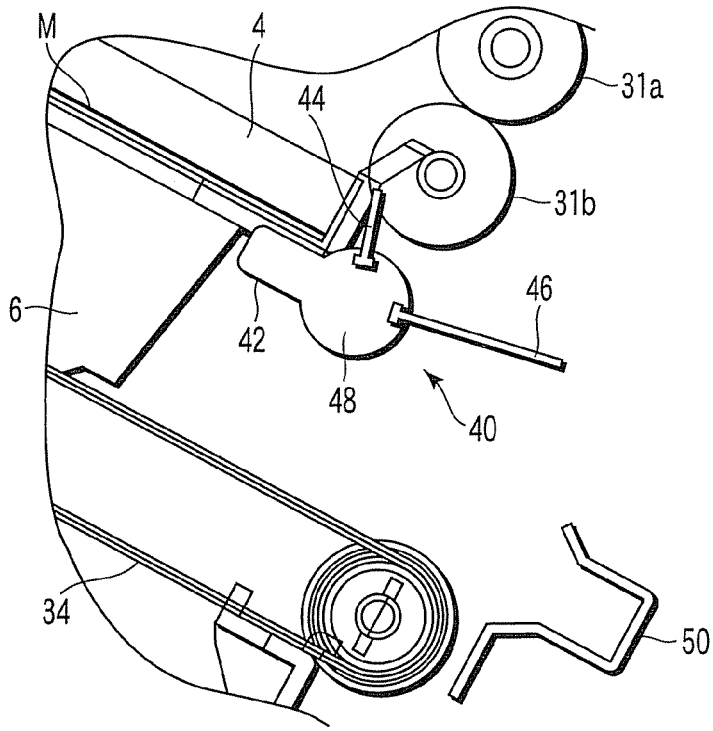
FIG. 5-FIG. 8 are views for explaining the operations of the feed member of FIG. 4 and the press member of FIG. 3.

First, in the standby state before the paper sheet M is fed from the digital copier 10, the feed member 40 is placed at the position shown in FIG. 5, and the press member 60 is placed at the position shown in FIG. 11B.

When a first paper sheet M is supplied to the post-processing apparatus 1 in this state, the paper sheet M is passed over the press member 60 and placed on the standby tray 4. In this time, the rear end of the paper sheet M in the feeding direction has passed over the press member 60, and is not completely supported by the tabs 42 of two feed members 40. Therefore, move the standby tray roller 32 down to the operating position, bring the standby tray roller 32 into contact with the first paper sheet M, rotate the standby tray roller in the reverse direction, send the paper sheet M slightly in the direction reverse to the feeding direction, and adjust the position of the paper sheet M by colliding its rear end with a not-shown stopper. In this state, the rear end of the paper sheet M in the feeding direction is completely supported by the two tabs 42. The standby tray roller 32 is retracted upward to receive the next paper sheet M.

Since the standby tray 4 is inclined downward to the upstream side of the feeding direction, the first paper sheet M is energized to the rear end side by its own weight. Since the width of the opening between the open/close trays 4*r* and 4*f* is enlarged toward the rear end of the paper sheet M, the central area at the rear end of the paper sheet M hangs down by its own weight. Namely, the area close to the center of the rear end of the hanging paper sheet M is supported by the tabs 42 of two feed members 40. In this state, the paper sheet M is simply placed on the open/close trays 4*r* and 4*f* and two tabs 42, and is movable by an external force.

The solenoid 62 is turned on, the press member 60 is pivotally moved from the retracted position shown in FIG. 11B to the operating position shown in FIG. 11A, and presses down the rear end of the first paper sheet M between two tabs 42 as shown in FIG. 10. In this time, since the press member 60 of this embodiment has the width slightly smaller than the space between two tabs 42, a relative strong shearing force is generated in the rear end side of the paper sheet M between these two tabs 42. The rear end of the paper sheet M is slightly bent, and clamped by the shearing force as shown in FIG. 10. The clamped rear end of the paper sheet M is given a relatively strong frictional force by the rubber material 61 of the press member 60, and the paper sheet M is not easily pulled out in this state.

When the second paper sheet M is passed over the press member 60 and supplied to the standby tray 4 in the state that the rear end of the first paper sheet M is being clamped (the state shown in FIG. 11A), the second paper sheet M is stacked on the first paper sheet M whose rear end is being clamped. In this time, since the rear end of the first paper sheet M is being clamped, even if the front end of the second paper sheet M in the feeding direction collides with the first paper sheet M, the position of the first paper sheet M is not disturbed and the second paper sheet M is normally stacked. The second paper sheet M will not be slipped under the first paper sheet M. Further, since the rear end of the first paper sheet M is being clamped by the press member 60, the second paper sheet M to be stacked after passing over the press member 60 will be stacked in the state displaced from the first paper sheet M.

Figure 6:
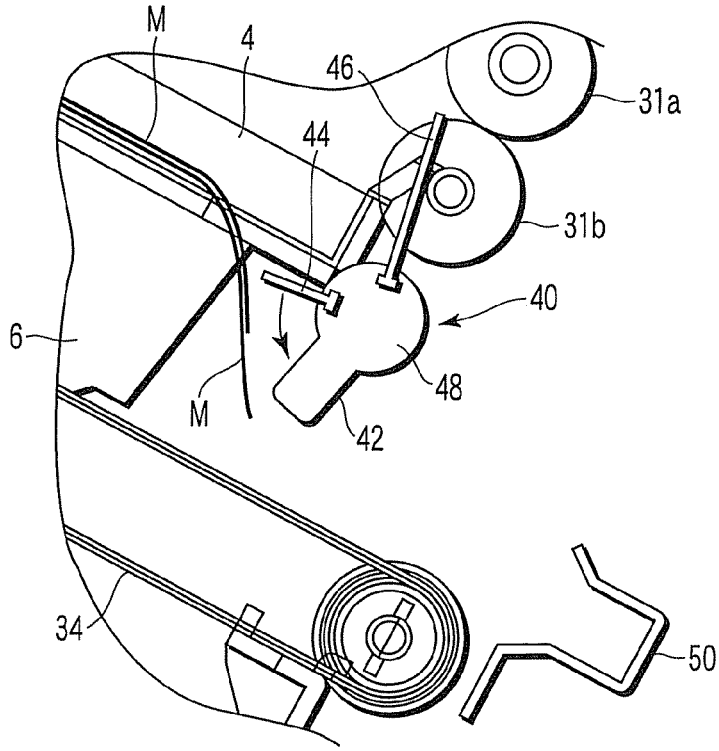

Then, the open/close trays 4*r* and 4*f* are opened, and two feed members 40 are rotated, the support of the paper sheets M by the tab 42 is released, the rear end of the paper sheets M are tapped by the stick 44 as shown in FIG. 6, and the stacked two paper sheets M are dropped onto the processing tray 6. In this time, as nothing exists under the press member 60 which has pressed the first paper sheet M, the rear end of the first paper sheet M is set free when released from the support by the tab 42. Further, the rear end of the second paper sheet M has passed over the tab 60, and the tab 60 will not obstruct the operation. The tab 60 is then moved to the retracted position shown in FIG. 11B at an appropriate timing.

As described above, the processing of stacking first and second paper sheets M on the standby tray 4 and dropping them onto the processing tray 6 after once being held there, is basically applied to a second bundle for which the staple mode is selected. Namely, since a second bundle of paper sheets M is not stacked on the processing tray 6 while a first bundle of paper sheets M stacked on the processing tray 6 is being stapled, there arises the necessity of holding the first several sheets (2 sheets in this embodiment) of a second bundle on the standby tray 4. The holding number of paper sheets M depends on the time required for stapling, and may be over 3 sheets.

The processing of holding several paper sheets M on the standby tray 4 is unnecessary when processing a first bundle of paper sheets having no preceding bundle, and may be used for the purpose of decreasing a noise. Because, considering a relative large noise generated when opening/closing the open/close trays 4*r* and 4*f* of the standby tray 4, the number of times to open/close the open/close trays 4*r* and 4*f* is desirably decreased. Therefore, in all cases that the staple mode is selected, it is preferable to hold at least two paper sheets M on the standby tray 4 before dropping onto the processing tray 6.

When holding three or more paper sheets M on the standby tray 4 in order to prolong the processing time in the processing tray 6, after supplying the second paper sheet M to the standby tray 4 as described above, retract the press member 60 upward, bring the standby tray roller 32 into contact with the second paper sheet M and rotate in the reverse direction, align the rear end of the second paper sheet M to the rear end of the first paper sheet M, move the press member 60 again to the operating position, clamp the rear end of the first and second paper sheets M, and receive a third paper sheet M. In this case, the third paper sheet M is stacked in the state displaced from the second paper sheet M, but drop the third paper sheet M onto the processing tray 6 in the displaced state, without clamping the rear end of the third paper sheet M. Likewise, when holding a fourth paper sheet M on the standby tray 4, do the same as for the third paper sheet.

When dropping two paper sheets M of the standby tray 4, since the width of the opening between the open/close trays 4*r* and 4*f* is enlarged toward the upstream side of the feeding direction, the rear end of the paper sheet M of the standby tray 4 is released first, and the rear end is oriented first to the processing tray 6 as shown in FIG. 6. At the same time, the central area of the rear end of the paper sheet M is tapped down toward the processing tray 6 by the stick 44, and the rear end of the paper sheet M is forcibly oriented to the processing tray 6. Further, as the processing tray 6 is inclined, the above-mentioned displacement is decreased by the drop of two paper sheets M.

Figure 7:
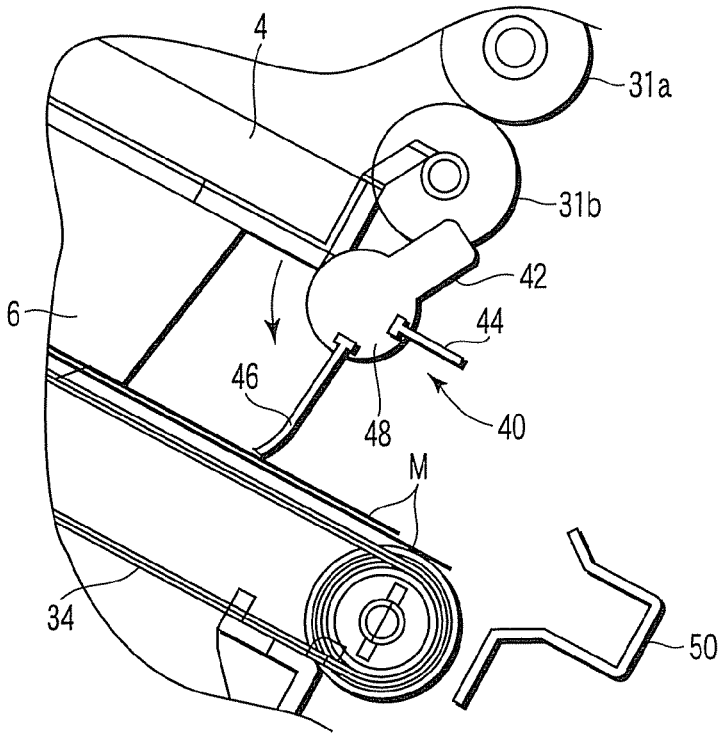

After two paper sheets M are dropped onto the processing tray 6, two feed members 40 are rotated furthermore, and the paddle 46 sends the area close to the rear end of the second paper sheet M dropped onto the processing tray 6, to the stopper 50, just like by scraping that area as shown in FIG. 7. In this time, the conveying mechanism 34 is operated to convey the paper sheets M stacked on the processing tray 6 to the stopper 50 by cooperating with the scraping action of the paddle 46. The paddle 46 is elastically deformed according to the thickness of the paper sheets M to be stacked on the processing tray.

In this time, since the paddle 46 contacts the second sheet of two stacked paper sheets M dropped with the rear ends displaced, the scraping force of the paddle 46 acts mainly on the second paper sheet M, and two paper sheets M will be sent to the stopper 50 while the displacement is corrected. Contrarily, if the displacement of paper sheets is reversed, the paddle 46 cannot correct the displacement.

When the number of paper sheets M to drop after once being held is set to three or more, the paddle 46 does not directly act on the paper sheet M put at the middle, and the middle paper sheet may not be collided with the stopper 50. But, it is confirmed by our experience that the positions of up to 5 paper sheets can be normally adjusted by the frictional force generated among the paper sheets.

Figure 8:
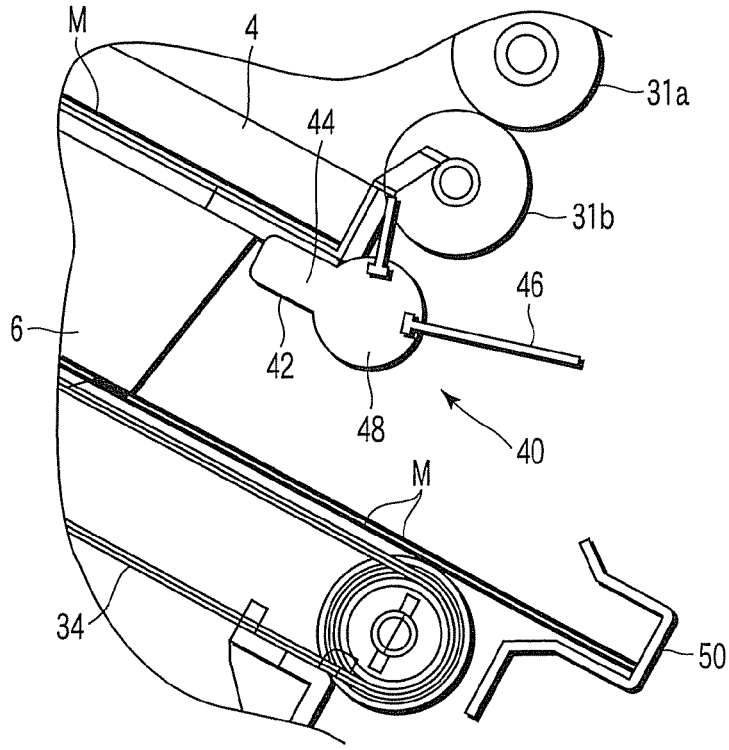

As described above, after two paper sheets M are dropped onto the processing tray 6 and their positions are adjusted by the stopper 50, the feed member 40 is rotated to the same position (home position) as when receiving the paper sheet M, as shown in FIG. 8, and becomes ready to receive a third paper sheet M.

When a third paper sheet M is supplied to the standby tray 4 in this state, the paper sheet M is passed over the press member 60 and stacked on the tray, the standby tray roller 32 contacts the paper sheet M and rotates reversely, and the position of the paper sheet M is adjusted by a not-shown stopper. In this state, the rear end of the third paper sheet M in the feeding direction is supported by the tab 42 of the feed member 40. The standby tray roller 32 is retracted to the upper position not to interfere with the paper sheet M, after adjusting the position of the third paper sheet M. In this time, it is unnecessary to clamp the rear end of the third paper sheet M by operating the press member 60.

Then, the open/close trays 4*r* and 4*f* are opened, the feed member 40 is rotated again, and a third paper sheet M is dropped onto the processing tray 6 and stacked on the second paper sheet M. The paddle 46 scraps the third paper sheet M to send it to the stopper 50, and the stopper 50 adjusts the rear end of the paper sheet M in the feeding direction. The above operations are repeated by the number of sheets to be stapled, and the predetermined number of paper sheets M is stacked on the processing tray 6.

In the description hereinbefore, paper sheets M on and after the third paper sheet are stacked one by one on the processing tray 6 through the standby tray 4. The invention is not to be limited to this. For example, the third and fourth paper sheets M may be once stacked on the standby tray 4 and then dropped collectively onto the processing tray 6 by opening the open/close trays 4*r* and 4*f*. In any case, the number of paper sheets M to be held on the standby tray 4 can be optionally set. Considering the problem of noise, it is desirable to decrease the number of times to open and close the open/close trays 4*r* and 4*f* as far as possible.

Figure 9:
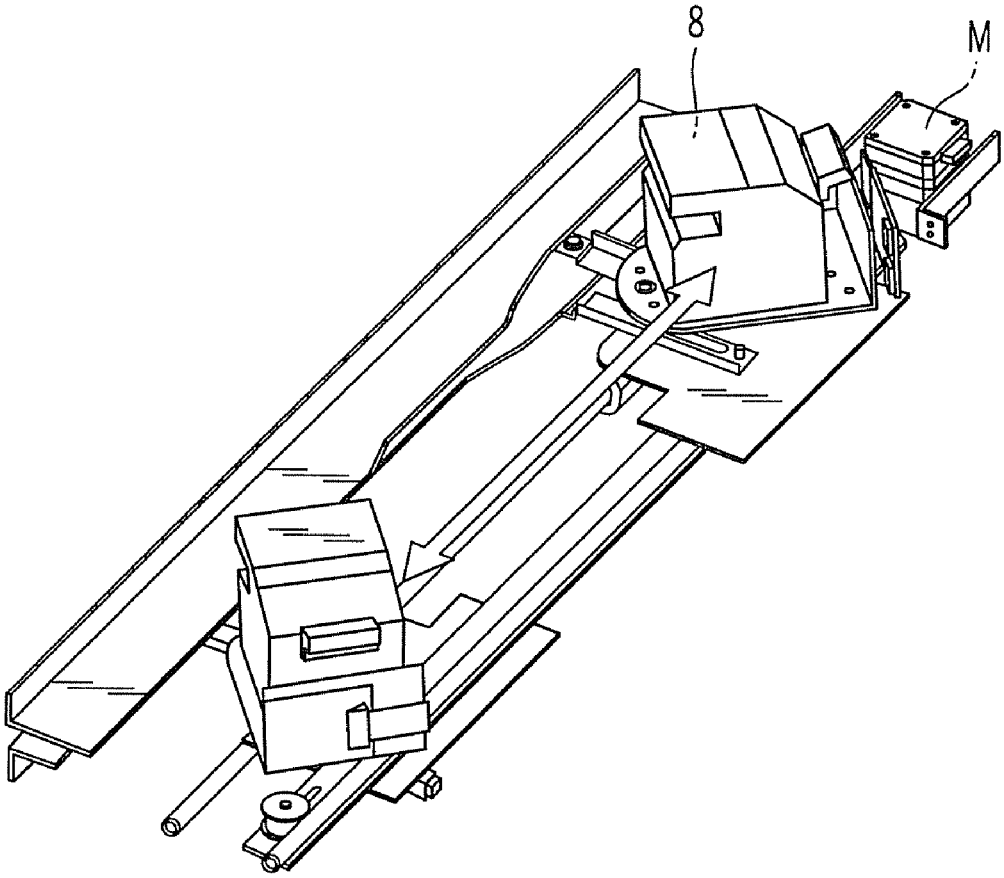
FIG. 9 is a view for explaining the operation of a stapler.

As described here, when a predetermined number of paper sheets M is stacked on the processing tray 6 and the rear ends are aligned, the stapler 8 provided movably along the rear end moves to the stapling position as shown in FIG. 9, and staples the predetermined number of paper sheets M at an appropriate position. The bundle of stapled paper sheets M is conveyed to the eject trays 36 and 38 by operating the conveying mechanism 34.

As described here, according to the post-processing apparatus 1 of the invention, when stacking two paper sheets M on the standby tray 4, the rear end of the first paper sheet M is clamped, and the second paper sheet M is received in the standby tray 4. This prevents a paper jam caused by the collision of the second paper sheet M with the first paper sheet M, slipping of the second paper sheet M under the first paper sheet, and disturbance of the position of the first paper sheet M caused by the collision of the second paper sheet M. Therefore, the paper sheet M can be stacked in the stable position on the standby tray 4, and the paper sheet M can be dropped onto the processing tray by keeping a good stacked state, and the rear end of the paper sheet M can be surely aligned on the processing tray 6.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, in the embodiment described here, an image is formed on a copy paper, and the copy paper is aligned and stapled as a paper sheet M. The kind of paper is not limited. The invention may be applied to an apparatus which handles other media such as mail and paper money.

Further, when the sort mode is selected in the digital copier 10, the paper sheet M is needless to be neatly aligned as for stapling, and it is desirable to stack the paper sheet M as many as possible on the standby tray 4. Namely, by increasing the number of paper sheets stacked on the standby tray 4, the number of times to open/close the open/close trays 4*r* and 4*f* can be decreased, and a noise can be decreased. However, when stacking the paper sheet M on the standby tray 4, it is necessary to clamp the rear end of the already stacked paper sheet M, and the stacking number of paper sheets is limited.

What is claimed is:

1. A paper sheet processing apparatus comprising:

a standby tray which receives a paper sheet to be fed in a first direction;

a press member which presses down the rear end of a paper sheet already received in the standby tray along the first direction, when receiving another paper sheet by the standby tray; and a plurality of tabs which receives the rear end of the paper sheet already received in the standby tray, wherein the tabs are separately provided along the rear end of the paper sheet, and clamps the rear end of the paper sheet already received in the standby tray by cooperating with said press member provided between the tabs, wherein the standby tray is an open/close tray which opens/closes between a supporting position supporting the paper sheet and a releasing position, and the clamped rear end is released after the release of the open/close tray.

2. The paper sheet processing apparatus according to claim 1, further comprising:

a processing tray which is provided under the standby tray, and receives a paper sheet dropped from the standby tray;

a stopper which comes in contact with the rear end of a paper sheet received in the processing tray; and a feed member which guides the rear end of a paper sheet received in the standby tray to the processing tray, scrapes and sends the paper sheet received in the processing tray to the stopper, and collides the rear end of the paper sheet with the stopper.

3. The paper sheet processing apparatus according to claim 1, wherein the feed member has the tabs to support the rear end of a paper sheet received in the standby tray.

4. The paper sheet processing apparatus according to claim 1, wherein the feed member has a stick to tap down the rear end of a paper sheet supported by the tab.

5. The paper sheet processing apparatus according to claim 1, wherein the feed member has an elastic paddle to scrape and send the paper sheet dropped onto the processing tray to the stopper.

6. The paper sheet processing apparatus according to claim 1, wherein the feed member has a rotary unit which is connected to a proximal end of a tab, a proximal end of the stick and a proximal end of the paddle.

7. The paper sheet processing apparatus according to claim 1, wherein the press member has a width slightly smaller than the space between the tabs.

8. The paper sheet processing apparatus according to claim 1, wherein the standby tray is inclined upward along the first direction.

9. A paper sheet processing apparatus comprising:

a standby tray which receives a paper sheet in a first substantially horizontal direction;

a processing tray which is provided under the standby tray, and receives a paper sheet dropped from the standby tray;

a stopper which comes in contact with the rear end of a paper sheet received in the processing tray along the first direction;

a feed member which is provided between the standby tray and processing tray, and has a tab to support the rear end of a paper sheet received in the standby tray, a stick to tap the rear end of this paper sheet downward, an elastic paddle to scrape and send the paper sheet dropped onto the processing tray to the stopper, and a rotary unit connected to the proximal ends of the tab, stick and paddle, guides the rear end of a paper sheet received in the standby tray to the processing tray, scrapes and sends the paper sheet dropped onto the processing tray to the stopper, and collides the rear end of the paper sheet with the stopper, by rotating the rotary unit; and a press member which presses down the rear end of a paper sheet received in the standby tray and supported by the tab, and clamps the rear end of the paper sheet by cooperating with the tab.

10. The paper sheet processing apparatus according to claim 9, wherein a plurality of the feed member is separately provided in the axial direction of the rotary unit; and the press member is provided between the feed members, and clamps the rear end of the paper sheet received in the standby tray by cooperating with the feed members.

11. The paper sheet processing apparatus according to claim 10, wherein the press member has a width slightly smaller than the space between the feed members.

12. The paper sheet processing apparatus according to claim 10, wherein the standby tray is an open/close tray which opens/closes between a supporting position supporting the paper sheet and a releasing position, and the clamped rear end is released after the release of the open/close tray.

13. The paper sheet processing apparatus according to claim 9, wherein the standby tray is inclined upward along the first direction.

14. The paper sheet processing apparatus according to claim 9, wherein the standby tray is an open/close tray which opens/closes between a supporting position supporting the paper sheet and a releasing position, and the clamped rear end is released after the release of the open/close tray.

* * * * *